US010323308B2

(12) United States Patent
Bergstrom et al.

(10) Patent No.: US 10,323,308 B2
(45) **Date of Patent: *Jun. 18, 2019**

(54) CORROSION RESISTANT LEAN AUSTENITIC STAINLESS STEEL

(71) Applicant: ATI Properties LLC, Albany, OR (US)

(72) Inventors: David S. Bergstrom, Allison Park, PA (US); James M. Rakowski, Allison Park, PA (US); Charles P. Stinner, Gibsonia, PA (US); John J. Dunn, Sarver, PA (US); John F. Grubb, Lower Burrell, PA (US)

(73) Assignee: ATI PROPERTIES LLC, Albany, OR (US)

( * ) Notice: Subject to any disclaimer, the term of this patent is extended or adjusted under 35 U.S.C. 154(b) by 274 days.

This patent is subject to a terminal disclaimer.

(21) Appl. No.: 15/446,467

(22) Filed: Mar. 1, 2017

(65) Prior Publication Data

US 2017/0167006 A1 Jun. 15, 2017

Related U.S. Application Data

(63) Continuation of application No. 14/497,747, filed on Sep. 26, 2014, now Pat. No. 9,624,564, which is a continuation of application No. 12/037,199, filed on Feb. 26, 2008, now Pat. No. 8,877,121.

(60) Provisional application No. 61/015,338, filed on Dec. 20, 2007.

(51) Int. Cl.

| | |
|---|---|
| ***C22C 38/44*** | (2006.01) |
| ***C22C 38/52*** | (2006.01) |
| ***C22C 38/58*** | (2006.01) |
| ***C22C 38/54*** | (2006.01) |
| ***C21D 8/02*** | (2006.01) |
| ***C22C 38/00*** | (2006.01) |
| ***C22C 38/02*** | (2006.01) |
| ***C22C 38/42*** | (2006.01) |

(52) U.S. Cl.

CPC ..... *C22C 38/58* (2013.01); *C21D 8/0205* (2013.01); *C22C 38/001* (2013.01); *C22C 38/002* (2013.01); *C22C 38/02* (2013.01); *C22C 38/42* (2013.01); *C22C 38/44* (2013.01); *C22C 38/52* (2013.01); *C22C 38/54* (2013.01)

(58) Field of Classification Search

None

See application file for complete search history.

(56) References Cited

U.S. PATENT DOCUMENTS

| | | | |
|---|---|---|---|
| 3,171,738 | A | 3/1965 | Renshaw et al. |
| 3,284,250 | A | 11/1966 | Scott et al. |
| 3,592,634 | A | 7/1971 | Denhard, Jr. et al. |
| 3,599,320 | A | 8/1971 | Brickner et al. |
| 3,615,365 | A | 10/1971 | McCunn |
| 3,645,725 | A | 2/1972 | Denhard, Jr. et al. |
| 3,650,709 | A | 3/1972 | Morsing |
| 3,716,691 | A | 2/1973 | Baybrook et al. |
| 3,736,131 | A | 5/1973 | Espy |
| 3,770,426 | A | 11/1973 | Kloske et al. |
| 3,854,938 | A | 12/1974 | Baybrook et al. |
| RE28,645 | E | 12/1975 | Aoki et al. |
| 4,099,966 | A | 7/1978 | Chivinsky et al. |
| 4,170,499 | A | 10/1979 | Thomas et al. |
| 4,325,994 | A | 4/1982 | Kitashima et al. |
| 4,340,432 | A | 7/1982 | Hede |
| 4,609,577 | A | 9/1986 | Long |
| 4,798,635 | A | 1/1989 | Bernhardsson et al. |
| 4,814,140 | A | 3/1989 | Magee, Jr. |
| 4,828,630 | A | 5/1989 | Daniels et al. |
| 4,985,091 | A | 1/1991 | Culling |
| 5,047,096 | A | 9/1991 | Eriksson et al. |
| RE33,753 | E | 11/1991 | Vacchiano et al. |
| 5,203,932 | A | 4/1993 | Kato et al. |
| 5,238,508 | A | 8/1993 | Yoshitake et al. |
| 5,254,184 | A | 10/1993 | Magee, Jr. et al. |
| 5,259,443 | A | 11/1993 | Osada et al. |
| 5,286,310 | A | 2/1994 | Carinci et al. |
| 5,298,093 | A | 3/1994 | Okamoto |
| 5,340,534 | A | 8/1994 | Magee |
| 5,496,514 | A | 3/1996 | Yamauchi et al. |

(Continued)

FOREIGN PATENT DOCUMENTS

| | | | |
|---|---|---|---|
| CA | 2638289 | A1 | 3/2008 |
| CA | 2674091 | A1 | 7/2008 |

(Continued)

OTHER PUBLICATIONS

"Stainless Steels Chromium-Nickel-Molybdenum Types 316 (S31600), 316L (S31603), 317 (S31700), 317L (S31703)", ATI Allegheny Ludlum Allegheny Technologies, Technical Data Blue Sheet, 2006, pp. 1-13.

"Stainless Steels Chromium-Nickel Types 302 (S30200), 304(S30400), 304L (S30403), 305 (S30500)", Allegheny Ludlum an Allegheny Technologies Company, Technical Data Blue Sheet, Allegheny Ludlum Corporation—Pittsburgh, PA, 1998, pp. 1-10.

(Continued)

*Primary Examiner* — Colleen P Dunn

*Assistant Examiner* — Anthony M Liang

(74) *Attorney, Agent, or Firm* — Robert J. Toth; K&L Gates LLP

(57) ABSTRACT

An austenitic stainless steel composition having low nickel and molybdenum and exhibiting high corrosion resistance and good formability. The austenitic stainless steel includes, in weight %, up to 0.20 C, 2.0-6.0 Mn, up to 2.0 Si, 16.0-23.0 Cr, 5.0-7.0 Ni, up to 3.0 Mo, up to 3.0 Cu, 0.1-0.35 N, up to 4.0 W, up to 0.01 B, up to 1.0 Co, iron and impurities. The austenitic stainless steel has a ferrite number less than 11 and an $MD_{30}$ value less than −10° C.

25 Claims, No Drawings

(56) References Cited

U.S. PATENT DOCUMENTS

| | | | |
|---|---|---|---|
| 5,514,329 | A | 5/1996 | McCaul et al. |
| 5,624,504 | A | 4/1997 | Miyakusu et al. |
| 5,672,215 | A | 9/1997 | Azuma et al. |
| 5,672,315 | A | 9/1997 | Okato et al. |
| 5,716,466 | A | 2/1998 | Yamaoka et al. |
| 5,733,387 | A | 3/1998 | Lee et al. |
| 5,849,111 | A | 12/1998 | Igarashi et al. |
| 6,042,782 | A | 3/2000 | Murata et al. |
| 6,056,917 | A | 5/2000 | Chesseret et al. |
| 6,096,441 | A | 8/2000 | Hauser et al. |
| 6,274,084 | B1 | 8/2001 | Haudrechy |
| 6,395,108 | B2 | 5/2002 | Eberle et al. |
| 6,551,420 | B1 | 4/2003 | Bergstrom et al. |
| 6,623,569 | B2 | 9/2003 | Bergstrom et al. |
| 6,824,672 | B2 | 11/2004 | Lecour et al. |
| 6,949,148 | B2 | 9/2005 | Sugiyama et al. |
| 6,958,099 | B2 | 10/2005 | Nakamura et al. |
| 7,014,719 | B2 | 3/2006 | Suzuki et al. |
| 7,014,720 | B2 | 3/2006 | Iseda |
| 7,070,666 | B2 | 7/2006 | Druschitz et al. |
| 7,090,731 | B2 | 8/2006 | Kashima et al. |
| 7,101,446 | B2 | 9/2006 | Takeda et al. |
| 7,842,434 | B2 | 11/2010 | Rakowski et al. |
| 7,981,561 | B2 | 7/2011 | Rakowski et al. |
| 8,313,691 | B2 | 11/2012 | Bergstrom et al. |
| 8,337,748 | B2 | 12/2012 | Rakowski et al. |
| 8,337,749 | B2 | 12/2012 | Bergstrom et al. |
| 8,858,872 | B2 | 10/2014 | Bergstrom et al. |
| 8,877,121 | B2 | 11/2014 | Bergstrom et al. |
| 9,121,089 | B2 | 9/2015 | Bergstrom et al. |
| 9,133,538 | B2 | 9/2015 | Rakowski et al. |
| 9,617,628 | B2 | 4/2017 | Bergstrom et al. |
| 9,624,564 | B2 | 4/2017 | Bergstrom et al. |
| 2002/0102178 | A1 | 8/2002 | Hiramatsu et al. |
| 2003/0021716 | A1 | 1/2003 | Hauser et al. |
| 2003/0086808 | A1 | 5/2003 | Sundstrom et al. |
| 2003/0099567 | A1 | 5/2003 | Suzuki et al. |
| 2003/0121567 | A1 | 7/2003 | Sugiyama et al. |
| 2003/0172999 | A1 | 9/2003 | Alfonsson et al. |
| 2003/0231976 | A1 | 12/2003 | Iseda |
| 2005/0103404 | A1 | 5/2005 | Hsieh et al. |
| 2005/0158201 | A1 | 7/2005 | Park et al. |
| 2005/0194073 | A1 | 9/2005 | Hamano et al. |
| 2005/0211344 | A1 | 9/2005 | Omura et al. |
| 2005/0232805 | A1 | 10/2005 | Takeda et al. |
| 2006/0196582 | A1 | 9/2006 | Lindh |
| 2006/0285993 | A1 | 12/2006 | Rakowski |
| 2014/0369882 | A1 | 12/2014 | Bergstrom et al. |
| 2015/0337421 | A1 | 11/2015 | Bergstrom et al. |
| 2015/0337422 | A1 | 11/2015 | Bergstrom et al. |
| 2017/0145548 | A1 | 5/2017 | Bergstrom et al. |

FOREIGN PATENT DOCUMENTS

| | | | |
|---|---|---|---|
| EP | 0151487 | A2 | 8/1985 |
| EP | 0156778 | A2 | 10/1985 |
| EP | 0171868 | A1 | 2/1986 |
| EP | 0260022 | A2 | 3/1988 |
| EP | 0314649 | B1 | 5/1989 |
| EP | 0694626 | A1 | 1/1996 |
| EP | 0750053 | A1 | 12/1996 |
| EP | 0659896 | B1 | 4/1997 |
| EP | 1061151 | A1 | 12/2000 |
| EP | 1106706 | A1 | 6/2001 |
| EP | 1645649 | A1 | 4/2006 |
| EP | 1690957 | A1 | 8/2006 |
| GB | 882983 | | 11/1961 |
| GB | 1514934 | A | 6/1978 |
| GB | 2075550 | A | 11/1981 |
| GB | 2166159 | A | 4/1986 |
| GB | 2205856 | A | 12/1988 |
| GB | 2359095 | A | 8/2001 |
| JP | 54-041214 | A | 4/1979 |
| JP | 56-119721 | A | 9/1981 |
| JP | 57-63666 | A | 4/1982 |
| JP | 59-211556 | A | 11/1984 |
| JP | 2-305940 | A | 12/1990 |
| JP | H4-214842 | A | 8/1992 |
| JP | 5-247592 | A | 9/1993 |
| JP | 5-295486 | A | 11/1993 |
| JP | 6-128691 | A | 5/1994 |
| JP | 6-224362 | A | 8/1994 |
| JP | 6-235048 | A | 8/1994 |
| JP | 6-314411 | A | 11/1994 |
| JP | 7-060523 | A | 3/1995 |
| JP | 7-233444 | A | 9/1995 |
| JP | 7-278760 | | 10/1995 |
| JP | 8-085820 | A | 4/1996 |
| JP | 8-170153 | A | 7/1996 |
| JP | 08-260101 | A | 10/1996 |
| JP | 8-283915 | A | 10/1996 |
| JP | 09-241746 | A | 9/1997 |
| JP | 9-302446 | A | 11/1997 |
| JP | 9-310157 | A | 12/1997 |
| JP | 10-102206 | A | 4/1998 |
| JP | 1-172524 | A | 7/1998 |
| JP | 2000-158183 | A | 6/2000 |
| JP | 2005-290538 | A | 10/2005 |
| JP | 2006-183129 | A | 7/2006 |
| JP | 2006-219751 | | 8/2006 |
| JP | 2007-84841 | A | 4/2007 |
| JP | 2008-127590 | | 6/2008 |
| JP | 2010-121162 | | 6/2010 |
| RU | 2107109 | C1 | 3/1998 |
| RU | 2155821 | C1 | 9/2000 |
| RU | 2167953 | C2 | 5/2001 |
| RU | 2173729 | C1 | 9/2001 |
| RU | 2207397 | C2 | 6/2003 |
| RU | 2246554 | C2 | 2/2005 |
| RU | 2270269 | C1 | 2/2006 |
| RU | 72697 | U1 | 4/2008 |
| SU | 874761 | A1 | 10/1981 |
| SU | 1301868 | A1 | 4/1987 |
| WO | WO 87/004731 | A1 | 8/1987 |
| WO | WO 95/06142 | A1 | 3/1995 |
| WO | WO 98/010888 | A1 | 3/1998 |
| WO | WO 99/32682 | A1 | 7/1999 |
| WO | WO 00/026428 | A1 | 5/2000 |
| WO | WO 02/027056 | A1 | 4/2002 |
| WO | WO 02/088411 | A1 | 11/2002 |
| WO | WO 03/033755 | A1 | 4/2003 |
| WO | WO 03/038136 | A1 | 5/2003 |
| WO | WO 03/080886 | A1 | 10/2003 |
| WO | WO 05/001151 | A1 | 1/2005 |
| WO | WO 05/045082 | A1 | 5/2005 |
| WO | WO 05/073422 | A1 | 8/2005 |
| WO | WO 06/071192 | A1 | 7/2006 |
| WO | WO 2009/070345 | A1 | 6/2009 |
| WO | WO 2009/082501 | A1 | 6/2009 |
| WO | WO 2009/082498 | A1 | 7/2009 |
| WO | WO 2010/087766 | A1 | 8/2010 |

OTHER PUBLICATIONS

"Stainless Steels Types 201 and 201L (UNS Designations S20100 and S20103)", ATI Allegheny Ludlum Allegheny Technologies, Technical Data Blue Sheet. 2005, pp. 1-8.

"Twice the yield strength of 304 stainless with comparable corrosion resistance. Low magnetic permeability retained after severe cold working. Resistance to chloride stress corrosion cracking superior to 304. Excellent strength and ductility at cryogenic temperatures. Wear and galling resistance superior to the standard austenitic grades", Carlson Alloy Nitronic 33 (ASTM XM-29, UNS S24000), Product Data Bulletin Nitronic 33, 1998, 4 pages.

"Nitrogen-strengthened austenitic stainless steel providing good aqueous corrosion resistance combined with resistance to abrasives and metal-to-metal wear. Higher mechanical properties than standard austenitic grades. Outstanding corrosive wear resistance under

(56) References Cited

OTHER PUBLICATIONS many different sliding conditions. Galling resistance equivalent to 304", Carlson Alloy Nitronic 33 (UNS S20400), Product Data Bulletin Nitronic 30, 1998, 2 pages.
Dr. Jacques Charles, "The New 200-Series: An Alternative Answer to NI. Surcharge? Dream or Nightmare?", U & A, ARCELOR. immeubie PACIFIC-11,13 cours Valmy F-92070 La Defense cedex., Sep. 27-30, 2005, pp. 1-9.
"Stainless Steel Chromium-Nickel-Manganese AL 201LN (UNS Designation S20153)", Allegheny Ludlum—An Allegheny Teledyne Company, Technical Data Blue Sheet, Allegheny Ludlum Corporation, 1998, pp. 1-5.
"Allegheny Ludlum Stainless Steel, Type 301 (UNS Designation S30100)", Allegheny Ludlum—An Allegheny Technologies Company, Technical Data Blue Sheet, Allegheny Ludlum Corporation, Pittsburgh, PA, 1998, pp. 1-6.
"Stainless Steel J216L—an Alternative to 316L", Jindal Stainless, pp. 1-5.
Yasuhiro Habara, "IMnl 30th Annual Conference 2004—Stainless Steel 200 Series: An Opportunity for Mn", Nippon Metal Industry, Co., Ltd., Mar. 2005, 24 pages.
"200 Series; Merits of 200 series, JSL grades, JSL AUS (201 Modified); Typical Applications for JSL AUS (201 Modified); J201 (UNS 520100); Typical Applications for J201 (UNS S20100); J4 (S20430 Modified); Typical Applications for J4 (S20430 Modified); J204Cu (UNS S20430); Typical Applications for J204Cu (UNS S20430); Chemistry, Mechanical Properties, Corrosion in Various Food Application Media; Manufacturing Range", Jindal Stainless, 15 pages.
Bridges, W.H., ed., "Metallurgy Division Quarterly Progress Report for Period Ending Oct. 31, 1952," Technical Report, OSTI ID: 4176086, Oak Ridge National Lab., Tenn. Accessed at http://www.osti.gov/energycitations/product.biblio.jsp?osti_id=4176086.
Habashi, F., "Historical Introduction to Refractory Metals," DOI: 10.1080/08827509808962488. Journal: Mineral Processing and Extractive Metallurgy Review, vol. 22, Issue 1, Dec. 1998, pp. 25-53. Accessed at http://www.informaworld.com/smpp/content~content=a779144442~db=all.
Hayes, E., "Chromium and Vanadium," Industrial Engineering and Chemistry, vol. 53, No. 2, pp. 105 (1961). Accessed at http://scholar.google.com/scholar?hl=en&ir=&q=stainless+steel+columbium%2C+vanadium%2C+zirconium+-patents&btnG=Search.
Hübler, R., et al., "Wear and corrosion protection of 316-L femoral implants by deposition of thin films," Surface and Coatings Technology, vols. 142-144, Jul. 2001, pp. 1078-1083. Accessed at http://www.sciencedirect.com/science?ob=ArticleURL&_udi=B6TVV-43WTXCV- G&_user=10&_coverDate=_rdoc=1&_fmt=&_orig=search&_sort=d&view=c&_acct=C000050221&_ version=1&_urlVersion=0&_userid=10&md5=415112522be6420c094812f0c8183ba0.
Kolukisa, S., "The effect of the process temperature on the bondability in diffusion bonding of ferritic (AISI 430) with martensitic; (AISI 420) stainless steels," Praktische Metallographie, 2006, vol. 43, No. 5, pp. 252-261. PASCAL. © 2007 INIST/CNRS. Dialog® File No. 144 Accession No. 18213150.
Li, Ping et al., "Failure analysis of the impeller of slurry pump used in zinc hydrometallurgy process," Engineering Failure Analysis, vol. 13, Issue 6, Sep. 2006, pp. 876-885. Accessed at http://www.sciencedirect.com/science?_ob=ArticleURL&_udi=B6V2X-4H21NH4-2&_user=10&_coverDate=09%2F30%2F2006&rdoc=1&_fmt=&_orig=search&sort=d&view=c&_acct=C000050221&_version=1&urlVersion=0&_userid=10&md5=401b17449fa1c06a3cf468b8915df508.
MacLeary, D.L., "Testing of Columbium and Columbium Alloys," Feb. 1, 1962, OSTI ID: 4810118. Journal: Corrosion; vol. 18, pp. 67t-9t. Accessed at http://www.osti.gov/energycitations/product.biblio.jsp?osti_id=4810118.
Ogawa, K., "Super duplex stainless steel and its weldability," Journal: Recent Progress in Welding Technology from the Viewpoint of Use of Stainless Steels, pp. 25-30, (2002). Accessed at http://sciencelinks.jp/j-east/article/200306/000020030603A0127311.php.
Okamoto, H., "The Effect of Tungsten and Molybdenum on the Performance of Super Duplex Stainless Steels," Applications of Stainless Steel '92. vol. 1; Stockholm; Sweden; Jun. 9-11, 1992, pp. 360-369. Accessed at http://md1.csa.com/partners/viewrecord.php?requester=gs&collection=TRD&recid=153063WS&recid=153063WS&recid=199307351097MD&q=PREw+and+stainless+steel+- patents&uid=789942086&setcookie=yes.
Okamoto, H., et al., "A new tungsten alloyed super Duplex Stainless Steel," Sumitomo Search, No. 54, pp. 21-29, Oct. 1993. INSPEC. Dialog® File No. 2 Accession No. 5652729.
Park, J.Y., et al., "The effects of heat-treatment parameters on corrosion resistance and phase transformations of 14Cr-3Mo martensitic stainless steel" Conference: RQ12 : International Conference on Rapidly Quenched & Metastable Materials, 12, (Jeju Island KOR), Aug. 21, 2005. Materials science & engineering. A, Structural materials. properties, microstructure and processing, 2007, vol. 449-451, pp. 1131-1134. PASCAL. Dialog® File No. 144 Accession No. 18102654.
Park, J.Y., et al., "Effects of austenitizing treatment on the corrosion resistance of 14Cr-3Mo martensitic stainless steel," Corrosion: (Houston, Tex.), 2006, vol. 62, No. 6, pp. 541-547. PASCAL. Dialog® File No. 144 Accession No. 17993399.
Park, H.S., "A study on alloy design of duplex stainless steel. Consideration on the difference of corrosion resistance between ferrite and austenite," Journal of the Corrosion Science Society of Korea, vol. 28, No. 1, pp. 78-92. Feb. 1999. Accessed at http://md1.csa.com/partners/viewrecord.php?requester=gs &collection=TRD&recid=199910352358MD&recid=993480CO&q=PREw+and+stainless+steel+-patents&uid-=789942086&setcookie=yes.
Scott, C., et al., "Microalloying with Vanadium for Improved Cold Rolled TRIP Steels," International Seminar 2005 on Application Technologies of Vanadium in Flat—Rolled Steels. Accessed at http://www.vanitec.org/pages/en/index.php.
Ueda, M., et al., "Performance of high resistant duplex stainless steel in chloride and sour environments," National Association of Corrosion Engineers, Corrosion-Resistant Alloys in Oil and Gas Production. vol. I (USA), 1996, pp. 588-608, 1996. Accessed at http://md1.csa.com/partners/viewrecord.php?requester=gs&collection=TRD&recid=199712352351MD&q=PREw+and+stainless+steel=-patents&uid=789942086setcookie=yes.
Bergstrom, D.S., "AL 201HP (UNS 520100) alloy: a high-performance, lower-nickel alternative to 300 series alloys", ATI Allegheny Ludlum, an Allegheny Technologies Company, 2005, 8 pages.
MaGee, J., "Development of Type 204 CU Stainless, A Low-Cost Alternate to Type 304", Carpenter Technology Corporation, Reading, PA. Jan. 2001. Accessed at http://crswnew.cartech.com/wnew/techarticles/TA00013.html on May 29, 2008.
"Stainless Steel AL 2205 TM Alloy (UNS Designation S31803)", Allegheny Ludlum, An Allegheny Teledyne Company, Technical Data Blue Sheet, Allegheny Ludlum Corporation—Pittsburgh, PA, 1998, 6 pages.
"Alloys Make the Grade"; "Welcome to AK Steel's Family of Stainless Steels"; "AK Steel, Stainless Steel Comparator"; "AK Steel Coated Stainless Steels"; "Glossary of Stainless Sheet and Strip Terms", AK Steel, 2000, 8 pages.
Goldschtain, M.I. et al., "Special Steels", Moscow, 'Metallurgy' Publisher, 1985, pp. 101-103 accompanied by English abstract.
J&L Specialty Steel, Inc. Commercial Products—Type 2205 (UNS 31803) Duplex Stainless Steel. [Accessed at http://www.jlspecialty.com/data/2205.htm on Aug. 8, 2001].
Dezurik "2205 Duplex Stainless Steel", Application Data 10.60-4, Jul. 1999, 3 pages.
"Duplex Stainless Steel AL 2003 TM Alloy (UNS S32003)", ATI Allegheny Ludlum, Allegheny Technologies, Technical Data Blue Sheet, 2006.
ASM International, Materials Park, Ohio, Metallographer's Guide: Practices and Procedures for Irons and Steels, Chapter 1, "Introduction to Steels and Cast Irons", p. 3, 1999.

(56) References Cited

OTHER PUBLICATIONS

J&L Type 201, "Austenitic Manganese Stainless Steel," Alloy Digest, ASM International, Nov. 1999, 2 pages.
Stahlschlussel, "Key to Steel", 10th Edition, 1974, West Germany, 3 pages.
"Hot forming and heat treatment of duplex stainless steels", Shop Sheet, International Molybdenum Association, 1999, pp. 100-101.
Pradhan, R., "Continuous Annealing of Steel", Heat Treating, vol. 4, ASM Handbook, ASM International, 1991, printed from http://products/asminternational.org, 3 pages.
"Forming of Stainless Steel and Heat-Resistant Alloys", ASM Handbook, ASM International, 2002, printed from http://products/asminternational.org, 2 pages.
ASM International, Materials Park, Ohio, Metallographer's Guide: Practices and Procedures for Irons and Steels, Chapter 1, "Introduction to Steels and Cast Irons", Table 1.1, p. 3, 1997.
Keown, S.R., "Boron in Steel", Scan. J. Metallurgy, 2, 1973, pp. 59-63.
Hertzman et al., "Influence of B and D on austenite reformation in duplex stainless steels", Swedish institute for Metals Research, IM-200-065, Dec. 2000, 30 pages.
Tsuge, S., "Effects of Impurity and Microalloying Elements on Hot Workability of Duplex Stainless Steels", Proceeding of International Conference on Stainless Steels, Jun. 1991, vol. 2, Chiba, Japan, pp. 799-806.
Office Action dated Jul. 15, 2010 in U.S. Appl. No. 12/034,183.
Office Action dated Dec. 2, 2010 in U.S. Appl. No. 12/034,183.
Office Action dated May 18, 2011 in U.S. Appl. No. 12/034,183.
Office Action dated Sep. 9, 2011 in U.S. Appl. No. 12/034,183.
Notice of Allowance dated Dec. 6, 2011 in U.S. Appl. No. 12/034,183.
Office Action dated May 10, 2012 in U.S. Appl. No. 12/034,183.
Notice of Allowance dated Sep. 10, 2012 in U.S. Appl. No. 12/034,183.
Office Action dated Jul. 15, 2010 in U.S. Appl. No. 12/610,577.
Office Action dated Dec. 2, 2010 in U.S. Appl. No. 12/610,577.
Office Action dated May 18, 2011 in U.S. Appl. No. 12/610,577.
Office Action dated Sep. 9, 2011 in U.S. Appl. No. 12/610,577.
Notice of Allowance dated Dec. 1, 2011 in U.S. Appl. No. 12/610,577.
Office Action dated May 15, 2012 in U.S. Appl. No. 12/610,577.
Notice of Allowance dated Sep. 7, 2012 in U.S. Appl. No. 12/610,577.
Response to Rule 312 Communication dated Oct. 29, 2012 in U.S. Appl. No. 12/610,577.
Office Action dated Jul. 15, 2010 in U.S. Appl. No. 12/037,477.
Office Action dated Dec. 2, 2010 in U.S. Appl. No. 12/037,477.
Office Action dated May 18, 2011 in U.S. Appl. No. 12/037,477.
Office Action dated Dec. 14, 2011 in U.S. Appl. No. 12/037,477.
Notice of Allowance dated Feb. 28, 2012 in U.S. Appl. No. 12/037,477.
Office Action dated Jul. 27, 2012 in U.S. Appl. No. 12/037,477.
Notice of Allowance dated Sep. 10, 2012 in U.S. Appl. No. 12/037,477.
Office Action dated Aug. 1, 2013 in U.S. Appl. No. 13/651,512.
Office Action dated Dec. 24, 2013 in U.S. Appl. No. 13/651,512.
Notice of Allowance dated Feb. 3, 2014 in U.S. Appl. No. 13/651,512.
Office Action dated May 16, 2014 in U.S. Appl. No. 13/651,512.
Notice of Allowance dated Jun. 30, 2014 in U.S. Appl. No. 13/651,512.
Corrected Notice of Allowability dated Aug. 25, 2014 in U.S. Appl. No. 13/651,512.
Office Action dated Jul. 15, 2010 in U.S. Appl. No. 12/037,199.
Office Action dated Dec. 9, 2010 in U.S. Appl. No. 12/037,199.
Office Action dated May 19, 2011 in U.S. Appl. No. 12/037,199.
Office Action dated Dec. 14, 2011 in U.S. Appl. No. 12/037,199.
Office Action dated May 10, 2012 in U.S. Appl. No. 12/037,199.
Office Action dated Sep. 10, 2012 in U.S. Appl. No. 12/037,199.
Advisory Action dated Nov. 13, 2012 in U.S. Appl. No. 12/037,199.
Office Action dated May 10, 2013 in U.S. Appl. No. 12/037,199.
Office Action dated Nov. 13, 2013 in U.S. Appl. No. 12/037,199.
Advisory Action dated Dec. 6, 2013 in U.S. Appl. No. 12/037,199.
Office Action dated Mar. 7, 2014 in U.S. Appl. No. 12/037,199.
Office Action dated May 15, 2014 in U.S. Appl. No. 12/037,199.
Advisory Action dated Jun. 13, 2014 in U.S. Appl. No. 12/037,199.
Notice of Allowance dated Aug. 26, 2014 in U.S. Appl. No. 12/037,199.
Office Action dated May 29, 2014 in U.S. Appl. No. 13/683,084.
Office Action dated Jul. 15, 2014 in U.S. Appl. No. 13/683,084.
Advisory Action dated Oct. 8, 2014 in U.S. Appl. No. 13/683,084.
Office Action dated Nov. 6, 2014 in U.S. Appl. No. 13/683,084.
Office Action dated Jan. 5, 2015 in U.S. Appl. No. 13/683,084.
Advisory Action dated Mar. 5, 2015 in U.S. Appl. No. 13/683,084.
Notice of Allowance dated May 1, 2015 in U.S. Appl. No. 13/683,084.
Office Action dated May 29, 2014 in U.S. Appl. No. 13/681,445.
Office Action dated Jul. 16, 2014 in U.S. Appl. No. 13/681,445.
Advisory Action dated Aug. 26, 2014 in U.S. Appl. No. 13/681,445.
Office Action dated Nov. 6, 2014 in U.S. Appl. No. 13/681,445.
Office Action dated Dec. 31, 2014 in U.S. Appl. No. 13/681,445.
Advisory Action dated Mar. 5, 2015 in U.S. Appl. No. 13/681,445.
Notice of Allowance dated Apr. 24, 2015 in U.S. Appl. No. 13/681,445.
Office Action dated Jun. 17, 2016 in U.S. Appl. No. 14/456,026.
Office Action dated Sep. 22, 2016 in U.S. Appl. No. 14/456,026.
Notice of Allowance dated Nov. 10, 2016 in U.S. Appl. No. 14/456,026.
Corrected Notice of Allowability dated Feb. 16, 2017 in U.S. Appl. No. 14/456,026.
Office Action dated Jun. 21, 2016 U.S. Appl. No. 14/818,852.
Office Action dated Oct. 4, 2016 in U.S. Appl. No. 14/818,852.
Notice of Allowance dated Feb. 2, 2017 in U.S. Appl. No. 14/818,852.
Office Action dated Mar. 27, 2017 in U.S. Appl. No. 14/818,852.
Office Action dated Jul. 22, 2016 in U.S. Appl. No. 14/818,868.
Office Action dated Nov. 14, 2016 in U.S. Appl. No. 14/818,868.
Notice of Allowance dated Mar. 1, 2017 in U.S. Appl. No. 14/818,868.
Office Action dated Mar. 28, 2017 in U.S. Appl. No. 14/818,868.
Office Action dated Jun. 27, 2016 in U.S. Appl. No. 14/497,747.
Notice of Allowance dated Dec. 30, 2016 in U.S. Appl. No. 14/497,747.
Corrected Notice of Allowability dated Mar. 21, 2017 in U.S. Appl. No. 14/497,747.
U.S. Appl. No. 15/427,667, filed Feb. 8, 2017.
Office Action dated Jul. 18, 2017 in U.S. Appl. No. 14/818,852.
Notice of Allowance dated Sep. 25, 2017 in U.S. Appl. No. 14/818,852.
Corrected Notice of Allowability dated Oct. 24, 2017 in U.S. Appl. No. 14/818,852.
Office Action dated Jul. 18, 2017 in U.S. Appl. No. 14/818,868.
Examiner Initiated Interview Summary and Notice of Allowance dated Oct. 11, 2017 in U.S. Appl. No. 14/818,868.

CORROSION RESISTANT LEAN AUSTENITIC STAINLESS STEEL

CROSS-REFERENCE TO RELATED APPLICATIONS

The present application claims priority under 35 U.S.C. § 120 as a continuation of co-pending U.S. patent application Ser. No. 14/497,747, filed Sep. 26, 2014, which in turn claims priority under 35 U.S.C. § 120 as a continuation of U.S. patent application Ser. No. 12/037,199, filed Feb. 26, 2008, now U.S. Pat. No. 8,877,121, which in turn claims priority under 35 U.S.C. § 119(e) to U.S. Provisional Patent Application Ser. No. 61/015,338, filed Dec. 20, 2007.

BACKGROUND OF THE INVENTION

Field of Technology

The present disclosure relates to an austenitic stainless steel. In particular, the disclosure relates to a cost-effective austenitic stainless steel composition having low nickel and low molybdenum yet having improved corrosion resistance and comparable formability properties compared to certain alloys containing higher nickel and molybdenum.

Description of the Background of the Technology

Austenitic stainless steels exhibit a combination of highly desirable properties that make them useful for a wide variety of industrial applications. These steels possess a base composition of iron that is balanced by the addition of austenite-promoting and stabilizing elements, such as nickel, manganese, and nitrogen, to allow additions of ferrite-promoting elements, such as chromium and molybdenum, which enhance corrosion resistance, to be made while maintaining an austenitic structure at room temperature. The austenitic structure provides the steel with highly desirable mechanical properties, particularly toughness, ductility, and formability.

An example of an austenitic stainless steel is EN 1.4432 stainless steel, which is a 16.5-18.5% chromium, 10.5-13% nickel, and 2.5-3.0% molybdenum-containing alloy. The ranges of alloying ingredients in this alloy are maintained within the specified ranges in order to maintain a stable austenitic structure. As is understood by one skilled in the art, nickel, manganese, copper, and nitrogen content, for example, contribute to the stability of the austenitic structure. However, the rising costs of nickel and molybdenum have created the need for cost-effective alternatives to EN 1.4432 that still exhibit high corrosion resistance and good formability. Recently, lean duplex alloys such as UNS S32003 (AL 2003™ alloy) have been used as lower-cost alternatives to EN 1.4432, but while these alloys have good corrosion resistance, they contain approximately 50% ferrite, which gives them higher strength and lower ductility than EN 1.4432, and as a consequence, they are not as formable. Duplex stainless steels are also more limited in use for both high and low temperatures, as compared to EN 1.4432.

Another austenitic alloy is Grade 317 (UNS S31700). S31700 contains 18.0-20.0% chromium, 11.0-15.0% nickel, and 3.0-4.0% molybdenum. Because of its higher Ni and Mo content, S31700 is a more costly alternative to EN 1.4432 and another commonly used austenitic grade, Type 316 (UNS S31600), which contains 16.0-18.0 chromium, 10.0-14.0% nickel, and 2.0-3.0% molybdenum. While the corrosion resistance of S31700 is superior to that of EN 1.4432 and S31600, its higher-cost raw materials make the use of S31700 too costly for many applications.

Another alloy alternative is Grade 216 (UNS S21600), which is described in U.S. Pat. No. 3,171,738. S21600 contains 17.5-22% chromium, 5-7% nickel, 7.5-9% manganese, 2-3% molybdenum, and 0.25-0.50 nitrogen. S21600 is a lower nickel, higher manganese variant of S31600 that contains very high nitrogen, which gives it greater strength and improves corrosion resistance. However, the formability of S21600 is not as good as that of S31600 or EN 1.4432, and the very low ferrite number of S21600 (−6.2) makes casting and welding more difficult. Also, because S21600 contains a similar amount of molybdenum as does EN 1.4432, switching to S21600 provides no cost savings for molybdenum.

Other examples of austenitic stainless steels include numerous alloys in which nickel is replaced with manganese to maintain an austenitic structure, such as is practiced with Type 201 steel (UNS S20100) and similar grades. However, although Type 201 steel is a low-nickel alloy having good corrosion resistance, it has poor formability properties. There is a need to be able to produce an alloy having corrosion resistance and formability as good as or better than those of EN 1.4432, while containing lower amounts of nickel and molybdenum, so as to be cost-effective. Furthermore, there is a need for such an alloy to have, unlike duplex alloys, a temperature application range comparable to that of standard austenitic stainless steels, for example from cryogenic temperatures up to 1000° F.

Accordingly, the present invention provides a solution that is not currently available in the marketplace, which is a formable austenitic stainless steel alloy composition that has corrosion resistance properties as good as or superior to those of EN 1.4432 but provides raw material cost savings. Accordingly, the invention is an austenitic alloy that uses a combination of the elements Mn, Cu, and N, to replace Ni and Mo in a manner to create an alloy with comparable or superior corrosion resistance, formability, and other properties relative to certain higher nickel and molybdenum alloys at a significantly lower raw material cost. Optionally, the elements W and Co may be used independently or in combination to replace the elements Mo and Ni, respectively.

SUMMARY OF THE INVENTION

The invention is an austenitic stainless steel that uses less expensive elements, such as manganese, copper, and nitrogen, as substitutes for the more costly elements of nickel and molybdenum. The result is a lower cost alloy that has corrosion resistance and formability as good as or better than those of EN 1.4432, and potentially as good as UNS S31700.

An embodiment of the austenitic stainless steel according to the present disclosure includes, in weight % up to 0.20 C, 2.0-6.0 Mn, up to 2.0 Si, 16.0-23.0 Cr, 5.0-7.0 Ni, up to 3.0 Mo, up to 3.0 Cu, 0.1-0.35 N, up to 4.0 W, up to 0.01 B, up to 1.0 Co, iron and impurities, and has a ferrite number less than about 11, and an $MD_{30}$ value of less than about −10° C.

Another embodiment of the austenitic stainless steel according to the present disclosure includes, in weight %, up to 0.20 C, 2.0-6.0 Mn, up to 2.0 Si, 16.0-23.0 Cr, 5.0-7.0 Ni, up to 3.0 Mo, up to 3.0 Cu, 0.1-0.35 N, up to 4.0 W, up to 0.01 B, up to 1.0 Co, iron and impurities, wherein $0.5 \leq (Mo+W/2) \leq 5.0$ and/or $5.0 \leq (Ni+Co) \leq 8.0$. The steel has a ferrite number less than about 11, and an $MD_{30}$ value of less than about −10° C.

Yet another embodiment of the austenitic stainless steel according to the present disclosure includes, in weight %, up to 0.08 C, 3.0-6.0 Mn, up to 2.0 Si, 17.0-23.0 Cr, 5.0-7.0 Ni, 0.5-3.0 Mo, up to 1.0 Cu, 0.14-0.35 N, up to 4.0 W, up to 0.008 B, up to 1.0 Co, iron and impurities, and has a ferrite number less than about 11, and an $MD_{30}$ value of less than about −10° C. In certain embodiments of the steel 0.5≤(Mo+W/2)≤5.0 and/or 5.0≤(Ni+Co)≤8.0.

A further embodiment of the austenitic stainless steel according to the present disclosure consists of up to 0.20 C, 2.0-6.0 Mn, up to 2.0 Si, 16.0-23.0 Cr, 5.0-7.0 Ni, up to 3.0 Mo, up to 3.0 Cu, 0.1-0.35 N, up to 4.0 W, up to 0.01 B, up to 1.0 Co, balance iron and impurities, and has a ferrite number less than 11 and an $MD_{30}$ value less than −10° C.

The austenitic stainless steel described in the present disclosure may have a $PRE_W$ value greater than about 26.

In an embodiment, a method of producing an austenitic stainless steel according to the present disclosure includes melting in an electric arc furnace, refining in an AOD, casting into ingots or continuously cast slabs, reheating the ingots or slabs and hot rolling to produce plates or coils, cold rolling to a specified thickness, and annealing and pickling the material. Other methods according to the invention may include for example, melting and/or re-melting in a vacuum or under a special atmosphere, casting into shapes, or the production of a powder that is consolidated into slabs or shapes, and the like.

Alloys according to the present disclosure may be used in numerous applications. According to one example, alloys of the present disclosure may be included in articles of manufacture adapted for use in low temperature or cryogenic environments. Additional non-limiting examples of articles of manufacture that may be fabricated from or include the present alloys are corrosion resistant articles, corrosion resistant architectural panels, flexible connectors, bellows, tube, pipe, chimney liners, flue liners, plate frame heat exchanger parts, condenser parts, parts for pharmaceutical processing equipment, part used in sanitary applications, and parts for ethanol production or processing equipment.

DETAILED DESCRIPTION OF THE INVENTION

In the present description and in the claims, other than in the operating examples or where otherwise indicated, all numbers expressing quantities or characteristics of ingredients and products, processing conditions, and the like are to be understood as being modified in all instances by the term "about". Accordingly, unless indicated to the contrary, any numerical parameters set forth in the following description and the attached claims are approximations that may vary depending upon the desired properties one seeks to obtain in the product and methods according to the present disclosure. At the very least, and not as an attempt to limit the application of the doctrine of equivalents to the scope of the claims, each numerical parameter should at least be construed in light of the number of reported significant digits and by applying ordinary rounding techniques. The austenitic stainless steels of the present invention will now be described in detail. In the following description, "%" represents "weight %", unless otherwise specified.

The invention is directed to an austenitic stainless steel. In particular, the invention is directed to an austenitic stainless steel composition that has corrosion resistance and formability as good as or better than those of EN 1.4432, and potentially as good as S31700. The austenitic stainless steel includes, in weight % up to 0.20 C, 2.0-6.0 Mn, up to 2.0 Si, 16.0-23.0 Cr, 5.0-7.0 Ni, up to 3.0 Mo, up to 3.0 Cu, 0.1-0.35 N, up to 4.0 W, up to 0.01 B, up to 1.0 Co, iron and impurities, and has a ferrite number less than about 11 and an $MD_{30}$ value of less than about −10° C.

An embodiment of the austenitic stainless steel according to the present disclosure includes, in weight %, up to 0.20 C, 2.0-6.0 Mn, up to 2.0 Si, 16.0-23.0 Cr, 5.0-7.0 Ni, up to 3.0 Mo, up to 3.0 Cu, 0.1-0.35 N, up to 4.0 W, up to 0.01 B, up to 1.0 Co, iron and impurities, wherein 0.5≤(Mo+W/2)≤5.0 and/or 5.0≤(Ni+Co)≤8.0. The steel has a ferrite number less than about 11, and an $MD_{30}$ value of less than about −10° C.

Yet another embodiment of the austenitic stainless steel according to the present disclosure includes, in weight %, up to 0.08 C, 3.0-6.0 Mn, up to 2.0 Si, 17.0-23.0 Cr, 5.0-7.0 Ni, 0.5-3.0 Mo, up to 1.0 Cu, 0.14-0.35 N, up to 4.0 W, up to 0.008 B, up to 1.0 Co, iron and impurities, and has a ferrite number less than about 11, and an $MD_{30}$ value of less than about −10° C. In certain embodiments of the steel 0.5≤(Mo+W/2)≤5.0 and/or 5.0≤(Ni+Co)≤8.0.

A further embodiment of the austenitic stainless steel according to the present disclosure consists of up to 0.20 C, 2.0-6.0 Mn, up to 2.0 Si, 16.0-23.0 Cr, 5.0-7.0 Ni, up to 3.0 Mo, up to 3.0 Cu, 0.1-0.35 N, up to 4.0 W, up to 0.01 B, up to 1.0 Co, balance iron and impurities, and has a ferrite number less than 11 and an $MD_{30}$ value less than −10° C.

C: Up to 0.20%

C acts to stabilize the austenite phase and inhibits deformation-induced martensitic transformation. However, C also increases the probability of forming chromium carbides, especially during welding, which reduces corrosion resistance and toughness. Accordingly, the austenitic stainless steel of the present invention has up to 0.20% C. In an embodiment of the invention, the content of C may be 0.08% or less.

Si: Up to 2.0%

Having greater than 2% Si promotes the formation of embrittling phases, such as sigma, and reduces the solubility of nitrogen in the alloy. Si also stabilizes the ferritic phase, and greater than 2% Si requires additional austenite stabilizers to maintain the austenitic phase. Accordingly, the austenitic stainless steel of the present invention has up to 2.0% Si. In an embodiment of the alloy, the Si content may be 1.0% or less. In certain embodiments, the effects of Si addition are balanced by adjusting the Si content to 0.5-1.0%.

Mn: 2.0-6.0%

Mn stabilizes the austenitic phase and generally increases the solubility of nitrogen, a beneficial alloying element. To sufficiently produce these effects, a Mn content of greater than 2.0% is required. Both Mn and N are effective substitutes for the more expensive element, Ni. However, having greater than 6.0% Mn would degrade the material's workability and its corrosion resistance in certain environments. Also, because the inventive alloy contains at least 5% Ni, more than 6.0% Mn should not be required to sufficiently stabilize the austenitic phase. Accordingly, the austenitic stainless steel of the present invention has 2.0-6.0% Mn. In an embodiment, the Mn content may be 3.0-6.0%.

Ni: 5.0-7.0%

Ni acts to stabilize the austenitic phase, as well as to enhance toughness and formability. However, due to the high cost of nickel, it is desirable to keep the Ni content low. The inventors have found that a 5.0-7.0% range of nickel will allow the austenitic phase to be maintained, while still allowing a sufficient amount of ferrite stabilizing elements such as Cr and Mo to be added to provide a material that has similar or superior corrosion performance to EN 1.4432 while maintaining similar toughness and formability at a lower cost. Accordingly, the austenitic stainless steel of the present invention includes 5.0-7.0% Ni.

Cr: 16.0-23.0%

Cr is added to impart corrosion resistance to stainless steels and also acts to stabilize the austenitic phase with respect to martensitic transformation. At least 16% Cr is required to provide adequate corrosion resistance. On the other hand, because Cr is a powerful ferrite stabilizer, a Cr content exceeding 23% requires the addition of more costly alloying elements, such as nickel or cobalt, to keep the ferrite content acceptably low. Having more than 23% Cr also makes the formation of undesirable phases, such as sigma, more likely. Accordingly, the austenitic stainless steel of the present invention has 16.0-23.0% Cr. In an embodiment, the Cr content may be 17.0-23.0%.

N: 0.1-0.35%

N is included in the alloy as a partial replacement for the austenite stabilizing element Ni and the corrosion enhancing element Mo. At least 0.1% N is necessary for strength and corrosion resistance and to stabilize the austenitic phase. The addition of more than 0.35% N may exceed the solubility of N during melting and welding, which results in porosity due to nitrogen gas bubbles. Even if the solubility limit is not exceeded, a N content of greater than 0.35% increases the propensity for the precipitation of nitride particles, which degrades corrosion resistance and toughness. Accordingly, the austenitic stainless steel of the present invention includes 0.1-0.35% N. In an embodiment, the N content may be 0.14-0.35%.

Mo: Up to 3.0%

The present inventors sought to limit mo content of the alloy while maintaining acceptable properties. Mo is effective in stabilizing the passive oxide film that forms on the surface of stainless steels and protects against pitting corrosion by the action of chlorides. In order to obtain these effects, Mo may be added in this invention up to a level of 3.0%. A Mo content exceeding 3.0% causes deterioration of hot workability by increasing the fraction of solidification (delta) ferrite to potentially detrimental levels. High Mo content also increases the likelihood of forming deleterious intermetallic phases, such as sigma phase. Accordingly, the austenitic stainless steel composition of the present invention includes up to 3.0% Mo. In an embodiment, the Mo content may be 0.5-3.0%.

Co: Up to 1.0%

Co acts as a substitute for nickel to stabilize the austenite phase. The addition of cobalt also acts to increase the strength of the material. The upper limit of cobalt is preferably 1.0%.

B: Up to 0.01%

Additions as low as 0.0005% B may be added to improve the hot workability and surface quality of stainless steels. However, additions of more than 0.01% degrade the corrosion resistance and workability of the alloy. Accordingly, the austenitic stainless steel composition of the present invention has up to 0.01% B. In an embodiment, the B content may be up to 0.008%, or may be up to 0.005%.

Cu: Up to 3.0%

Cu is an austenite stabilizer and may be used to replace a portion of the nickel in this alloy. It also improves corrosion resistance in reducing environments and improves formability by reducing the stacking fault energy. However, additions of more than 3% Cu have been shown to reduce the hot workability of austenitic stainless steels. Accordingly, the austenitic stainless steel composition of the present invention has up to 3.0% Cu. In an embodiment, Cu content may be up to 1.0%.

W: Up to 4.0%

W provides a similar effect to that of molybdenum in improving resistance to chloride pitting and crevice corrosion. W may also reduce the tendency for sigma phase formation when substituted for molybdenum. However, additions of more than 4% may reduce the hot workability of the alloy. Accordingly, the austenitic stainless steel composition of the present invention has up to 4.0% W.

$0.5 \leq (Mo+W/2) \leq 5.0$

Molybdenum and tungsten are both effective in stabilizing the passive oxide film that forms on the surface of stainless steels and protects against pitting corrosion by the action of chlorides. Since W is approximately half as effective (by weight) as Mo in increasing corrosion resistance, a combination of $(Mo+W/2)>0.5\%$ is required to provide the necessary corrosion resistance. However, having too much Mo increases the likelihood of forming intermetallic phases, and too much W reduces the hot workability of the material. Therefore, the combination of (Mo+W/2) should be less than 5%. Accordingly, the austenitic stainless steel composition of the present invention has $0.5 \leq (Mo+W/2) \leq 5.0$.

$5.0 \leq (Ni+Co) \leq 8.0$

Nickel and cobalt both act to stabilize the austenitic phase with respect to ferrite formation. At least 5% (Ni+Co) is required to stabilize the austenitic phase in the presence of the elevated levels of ferrite stabilizing elements such as Cr and Mo, which must be added to ensure superior corrosion resistance. However, both Ni and Co are costly elements, so it is desirable to keep the (Ni+Co) content less than 8%. Accordingly, the austenitic stainless steel composition of the present invention has $5.0 \leq (Ni+Co) \leq 8.0$.

The balance of the austenitic stainless steel of the present invention includes iron and unavoidable impurities, such as phosphorus and sulfur. The unavoidable impurities are preferably kept to the lowest practical level, as understood by one skilled in the art.

The austenitic stainless steel of the present invention can also be defined by equations that quantify the properties they exhibit, including, for example, pitting resistance equivalence number, ferrite number, and $MD_{30}$ temperature.

The pitting resistance equivalence number ($PRE_N$) provides a relative ranking of an alloy's expected resistance to pitting corrosion in a chloride-containing environment. The higher the $PRE_N$, the better the expected corrosion resistance of the alloy. The $PRE_N$ can be calculated by the following formula:

$$PRE_N = \%\ Cr + 3.3(\%\ Mo) + 16(\%\ N)$$

Alternatively, a factor of 1.65(% W) can be added to the above formula to take into account the presence of tungsten in an alloy. Tungsten improves the pitting resistance of stainless steels and is about half as effective as molybdenum by weight. When tungsten is included in the calculation, the pitting resistance equivalence number is designated as $PRE_W$, which is calculated by the following formula:

$$PRE_W = \%\ Cr + 3.3(\%\ Mo) + 1.65(\%\ W) + 16(\%\ N)$$

Tungsten serves a similar purpose as molybdenum in the invented alloy. As such, tungsten may be added as a substitute for molybdenum to provide increased pitting resistance. According to the equation, twice the weight percent of tungsten should be added for every percent of molybdenum removed to maintain the same pitting resistance. Embodiments of the alloy of the present invention may have a $PRE_W$ value of greater than 26, and preferably is as high as 30.

The alloy of the invention also may be defined by its ferrite number. A positive ferrite number generally correlates to the presence of ferrite, which improves an alloy's solidification properties and helps to inhibit hot cracking of the alloy during hot working and welding operations. A small amount of ferrite is thus desired in the initial solidified microstructure for good castability and for prevention of hot-cracking during welding. On the other hand, too much ferrite can result in problems during service, including but not limited to, microstructural instability, limited ductility, and impaired high temperature mechanical properties. The ferrite number can be calculated using the following equation:

$$FN=3.34(Cr+1.5Si+Mo+2Ti+0.5Cb)-2.46(Ni+30N+30C+0.5Mn+0.5Cu)-28.6$$

The alloy of the present invention has a calculated ferrite number of up to 11, preferably a positive number, and more preferably about 3 to 7. It will be apparent from the following discussion that certain known stainless steel alloys including relatively low nickel and molybdenum contents have ferrite numbers significantly lower than alloys according to the present disclosure.

The $MD_{30}$ temperature of an alloy is defined as the temperature at which cold deformation of 30% will result in a transformation of 50% of the austenite to martensite. The lower the $MD_{30}$ temperature is, the more resistant a material is to martensite transformation. Resistance to martensite formation results in a lower work hardening rate, which results in good formability, especially in drawing applications. $MD_{30}$ is calculated according to the following equation:

$$MD_{30}(^\circ C.)=413-462(C+N)-9.2(Si)-8.1(Mn)-13.7(Cr)-9.5(Ni)-17.1(Cu)-18.5(Mo)$$

The alloy of the present invention has a $MD_{30}$ temperature of less than −10° C., preferably less than about −30° C. Many of the known low-nickel stainless steel alloys have $MD_{30}$ values significantly greater than those of the alloys according to the present disclosure.

EXAMPLES

Table 1 includes the compositions and calculated parameter values for Inventive Alloys 1-3 and for Comparative Alloys, CA1, EN 1.4432, S31600, S21600, S31700 and S20100.

Inventive Alloys 1-3 and Comparative Alloy CA1 were melted in a laboratory-size vacuum furnace and poured into 50-lb ingots. These ingots were re-heated and hot rolled to produce material about 0.250" thick. This material was annealed, blasted, and pickled. Some of that material was cold rolled to 0.100"-thick, and the remainder was cold rolled to 0.050 or 0.040"-thick. The cold rolled material was annealed and pickled. Comparative Alloys EN1.4432, S31600, S21600, S31700 and S20100 are commercially available and the data shown for these alloys were taken from published literature or measured from testing of material recently produced for commercial sale.

The calculated $PRE_W$ values for each alloy are shown in Table 1. Using the equation discussed herein above, the alloys having a $PRE_W$ greater than 26.0 would be expected to have better resistance to chloride pitting than EN 1.4432 material. A $PRE_W$ of greater than 29.0 would be expected to have at least equivalent resistance to chloride pitting as S31700.

The ferrite number for each alloy in Table 1 has also been calculated. The ferrite numbers of Inventive Alloys 1-3 are between 5.0 and 7.5. These are within the desired range to promote good weldability and castability.

The $MD_{30}$ values were also calculated for the alloys in Table 1. According to the calculations, all of the Inventive Alloys exhibit greater resistance to martensite formation than S31600.

TABLE 1

| | Inventive Alloys | | | Comparative Alloys | | | | | |
|---|---|---|---|---|---|---|---|---|---|
| | 1 | 2 | 3 | CA1 | EN | S31700 | S3160 | S2160 | S2010 |
| C | 0.019 | 0.013 | 0.024 | 0.019 | 0.02 | 0.016 | 0.017 | 0.018 | 0.02 |
| Mn | 5.8 | 5.5 | 5.9 | 4.7 | 1.2 | 1.6 | 1.24 | 8.3 | 6.7 |
| Si | 0.27 | 0.28 | 0.28 | 0.28 | 0.4 | 0.4 | 0.45 | 0.40 | 0.40 |
| Cr | 19.8 | 19.8 | 22.7 | 18.1 | 16.9 | 18.3 | 16.3 | 19.7 | 16.4 |
| Ni | 6.1 | 6.1 | 6.9 | 4.5 | 10.7 | 13.1 | 10.1 | 6.0 | 4.1 |
| Mo | 1.51 | 1.34 | 0.59 | 1.13 | 2.6 | 3.2 | 2.1 | 2.5 | 0.26 |
| Cu | 0.40 | 1.98 | 0.71 | 0.40 | 0.4 | 0.4 | 0.38 | 0.40 | 0.43 |
| N | 0.195 | 0.181 | 0.220 | 0.210 | 0.04 | 0.06 | 0.04 | 0.37 | 0.15 |
| P | 0.018 | 0.019 | 0.016 | 0.002 | 0.03 | 0.025 | 0.03 | 0.03 | 0.03 |
| S | 0.0015 | 0.0018 | 0.0022 | 0.0001 | 0.0010 | 0.001 | 0.0010 | 0.0010 | 0.0010 |
| W | 0.12 | 0.06 | 0.01 | 0.09 | 0.1 | 0.1 | 0.11 | 0.10 | 0.1 |
| B | 0.0025 | 0.0019 | — | 0.0001 | 0.0025 | 0.0025 | 0.0025 | 0.0025 | 0.0005 |
| Fe | 65.6 | 64.6 | 62.2 | 70.4 | 67.9 | 62.5 | 68.8 | 62.2 | 71.4 |
| Co | 0.10 | 0.07 | 0.09 | 0.10 | 0.3 | 0.33 | 0.35 | 0.10 | 0.10 |
| FN | 5.6 | 5.0 | 7.5 | 2.8 | 5.9 | 4.8 | 4.1 | −6.2 | −2.3 |
| $PRE_W$ | 28.3 | 27.4 | 28.2 | 25.5 | 26.1 | 29.9 | 24.0 | 33.9 | 19.7 |
| $MD_{30}$ | −99.4 | −112.1 | −149.7 | −52.4 | −16.2 | −79.4 | 7.8 | −217.4 | 0.7 |
| RMCI | 0.71 | 0.68 | 0.64 | 0.56 | 1.09 | 1.31 | 1.00 | 0.83 | 0.43 |
| Yield | 54.4 | 52.2 | 59.3 | 49.1 | 43 | 48 | 43.5 | 55 | 43 |
| Tensile | 108.0 | 105.4 | 111.1 | 108.7 | 87 | 92 | 90.6 | 100 | 100 |
| % E | 42 | 38 | 32 | 68 | 55 | 46 | 56 | 45 | 56 |
| OCH | 0.37 | 0.36 | 0.33 | 0.45 | — | — | 0.45 | — | — |
| SSCVN | 56.0 | 50.3 | 42.3 | 61.7 | — | — | 70 | — | — |
| CPT | 29.2 | 23.8 | 29.8 | 14.6 | 23.0 | 34.1 | 12.9 | — | <2.0 |

Table 1 shows a raw material cost index (RMCI), which compares the material costs for each alloy to that of S31600. The RMCI was calculated by multiplying the average October 2007 cost for the raw materials Fe, Cr, Mn, Ni, Mo, W, and Co by the percent of each element contained in the alloy and dividing by the cost of the raw materials in S31600. As the calculated values show, the Inventive Alloys have RMCI values between 0.64 and 0.71, which means the cost of the raw materials contained therein are between 64 and 71% of those in S31600. In contrast, the RMCI for EN 1.4432 is 1.09. Nevertheless, the ferrite number for each Inventive Alloy is comparable to that listed for EN 1.4432, and the $MD_{30}$ values for the Inventive Alloys are substantially lower than that for EN 1.4432. That a material could be made that has formability and corrosion resistance at least comparable to EN 1.4432, but at a significantly lower raw material cost, is surprising and was not anticipated from the prior art.

The mechanical properties of the Inventive Alloys 1-3 have been measured and compared to those of Comparative Alloy CA1 and commercially available EN 1.4432, S31600, S21600, S31700, and S20100. The measured yield strength, tensile strength, percent elongation over a 2-inch gage length, ½-size Charpy V-notch impact energy, and Olsen cup height are shown in Table 1 for these alloys. The tensile tests were conducted on 0.100" gage material, the Charpy tests were conducted on 0.197" thick samples, and the Olsen cup tests were run on material between 0.040- and 0.050-inch thick. All tests were performed at room temperature. Units for the data in Table 1 are as follows: yield strength and tensile strength, ksi; elongation, percent; Olsen cup height, inches; Charpy impact energy, ft-lbs. As can be seen from the data, the Inventive Alloys exhibited slightly greater strength and lower percent elongation than those reported for EN 1.4432, thereby providing at least comparable formability properties to those of EN 1.4432.

An electrochemical critical pitting temperature test was performed in accordance with ASTM Standard G150 on samples of Inventive Alloys 1-3 and Comparative Alloys CA1, EN 1.4432, S31600, S31700, and S20100. As can be seen from the results in Table 1, Inventive Alloy 2 has a critical pitting temperature similar to that of EN 1.4432, while Inventive Alloys 1 and 3 have critical pitting temperatures significantly higher than that of EN 1.4432 and more than twice as high as that of S31600. That an alloy having raw material costs between 29% and 36% lower than those in S31600 would have a critical pitting temperature approximately 16° C. higher while still having comparable toughness and formability is surprising to the inventors.

The potential uses of this new alloy are numerous. As described and evidenced above, the austenitic stainless steel compositions described herein are capable of being used in many applications where the formability and toughness of S31600 are required, but greater corrosion resistance is needed. Additionally, due to the high cost of nickel and molybdenum, a significant cost savings will be recognized by switching from S31600 or EN 1.4432 to the Inventive Alloy. Another benefit is, because the Inventive Alloys are fully austenitic, they will not be susceptible to either a sharp ductile-to-brittle transition (DBT) at sub-zero temperature or 885° F. embrittlement. Therefore, unlike duplex alloys, they can be used at temperatures above 650° F. and are prime candidate materials for low temperature and cryogenic applications. It is expected that the formability and processability of the alloys described herein will be very close to those of standard austenitic stainless steels. Specific articles of manufacture for which the alloys according to the present disclosure would be particularly advantageous include, for example, flexible connectors for automotive exhaust and other applications, bellows, flexible pipe, and chimney/flue liners. Those having ordinary skill may readily manufacture these and other articles of manufacture from the alloys according to the present disclosure using conventional manufacturing techniques.

Although the foregoing description has necessarily presented only a limited number of embodiments, those of ordinary skill in the relevant art will appreciate that various changes in the apparatus and methods and other details of the examples that have been described and illustrated herein may be made by those skilled in the art, and all such modifications will remain within the principle and scope of the present disclosure as expressed herein and in the appended claims. It is understood, therefore, that the present invention is not limited to the particular embodiments disclosed or incorporated herein, but is intended to cover modifications that are within the principle and scope of the invention, as defined by the claims. It will also be appreciated by those skilled in the art that changes could be made to the embodiments above without departing from the broad inventive concept thereof.

We claim:

1. An austenitic stainless steel comprising, in weight %,
up to 0.20 C,
2.0-6.0 Mn,
greater than 0.5 to less than 1.0 Si,
16.0-23.0 Cr,
5.0-7.0 Ni,
less than 1.5 Mo,
0.1-0.30 N,
up to 4.0 W,
0.0005-0.01 B,
up to 1.0 Co,
iron, and
impurities,
the steel having a ferrite number between 5.6 and 11, an $MD_{30}$ value less than −10° C., and wherein $0.5 \leq (Mo+W/2) \leq 3.5$.

2. The austenitic stainless steel according to claim 1, having a $MD_{30}$ value less than −30° C.

3. The austenitic stainless steel according to claim 1, wherein C is limited to up to 0.08.

4. The austenitic stainless steel according to claim 1, wherein Mn is limited to 3.0-6.0.

5. The austenitic stainless steel according to claim 1, wherein Cr is limited to 17.0-23.0.

6. The austenitic stainless steel according to claim 1, wherein N is limited to 0.14-0.30.

7. The austenitic stainless steel according to claim 1, wherein Mo is limited to 0.5 to less than 1.5.

8. The austenitic stainless steel according to claim 1, wherein B is limited to 0.0005-0.008.

9. The austenitic stainless steel according to claim 1, wherein Mo is limited to 0.5 to less than 1.5, and wherein $5.0 \leq (Ni+Co) \leq 8.0$.

10. The austenitic stainless steel of claim 9, having a $MD_{30}$ value less than −30° C.

11. The austenitic stainless steel according to claim 1, wherein Mo is 0.5 to less than 1.5, and having a $MD_{30}$ value less than −30° C.

12. The austenitic stainless steel according to claim 1, comprising, in weight %,
up to 0.08 C, 3.0-6.0 Mn,
greater than 0.5 to less than 1.0 Si,
17.0-23.0 Cr,
5.0-7.0 Ni,
0.5 to less than 1.5 Mo,
0.14-0.30 N,
up to 4.0 W,
0.0005-0.008 B,
up to 1.0 Co,
iron, and impurities, the steel having a ferrite number between 5.6 and 11, an $MD_{30}$ value less than −10° C., and wherein 0.5≤(Mo+W/2)≤3.5.

13. The austenitic stainless steel according to claim 1, wherein Cr is limited to 16.0-19.8.

14. The austenitic stainless steel according to claim 1, wherein Mo is limited to up to 1.0.

15. The austenitic stainless steel according to claim 1, wherein Mn is limited to 3.5-6.0.

16. An article of manufacture including an austenitic stainless steel comprising, in weight %, up to 0.20 C,
2.0-6.0 Mn,
greater than 0.5 to less than 1.0 Si,
16.0-23.0 Cr,
5.0-7.0 Ni,
less than 1.5 Mo,
0.1-0.30 N,
up to 4.0 W,
0.0005-0.01 B,
up to 1.0 Co,
iron, and
impurities, the steel having a ferrite number between 5.6 and 11, an $MD_{30}$ value less than −10° C., and wherein 0.5≤(Mo+W/2)≤3.5.

17. The article of manufacture of claim 16, wherein the austenitic stainless steel has a $MD_{30}$ value less than −30° C.

18. The article of manufacture of claim 16, wherein Mo is 0.5 to less than 1.5.

19. The article of manufacture of claim 16, wherein the article is adapted for use in at least one of a low temperature environment and a cryogenic environment.

20. The article of manufacture of claim 16, wherein the article is selected from the group consisting of a corrosion resistant article, a corrosion resistant architectural panel, a flexible connector, a bellows, a tube, a pipe, a chimney liner, a flue liner, a plate frame heat exchanger part, a condenser part, a part for pharmaceutical processing equipment, a sanitary part, a part for ethanol production equipment, and a part for ethanol processing equipment.

21. The article of manufacture of claim 16, wherein Cr is limited to 16.0-19.8.

22. The article of manufacture of claim 16, wherein Mo is limited to 0.5 to less than 1.5.

23. The article of manufacture of claim 16, wherein Mo is limited to up to 1.0.

24. The article of manufacture of claim 16 including an austenitic stainless steel comprising, in weight %, up to 0.08 C,
3.0-6.0 Mn,
greater than 0.5 to less than 1.0 Si,
17.0-23.0 Cr,
5.0-7.0 Ni,
less than 1.5 Mo,
0.14-0.30 N,
up to 4.0 W,
0.0005-0.008 B,
up to 1.0 Co,
iron, and
impurities, the steel having a ferrite number between 5.6 and 11, an $MD_{30}$ value less than −10° C., and wherein 0.5≤(Mo+W/2)≤3.5.

25. The article of manufacture of claim 16, wherein Mn is limited to 3.5-6.0.

* * * * *